United States Patent [19]

DuRocher

[11] Patent Number: 4,617,437

[45] Date of Patent: Oct. 14, 1986

[54] IGNITION SWITCH WITH SELF-ADJUSTING HEADLAMP DIMMER

[75] Inventor: Daniel J. DuRocher, Nauvoo, Ill.

[73] Assignee: Methode Electronics, Inc., Chicago, Ill.

[21] Appl. No.: 618,525

[22] Filed: Jun. 8, 1984

[51] Int. Cl.[4] ..... H01H 3/40

[52] U.S. Cl. ..... 200/153 P; 200/18; 200/156

[58] Field of Search ..... 200/153 P, 418, 61.54, 200/307, 329, 337, 156, 155 R; 338/117, 200

[56] References Cited

U.S. PATENT DOCUMENTS

| | | | |
|---|---|---|---|
| 1,317,727 | 10/1919 | Ringer | 200/153 P |
| 1,781,970 | 11/1930 | Benjafield | 200/156 |
| 2,144,665 | 1/1939 | Rasmussen | 200/153 P |
| 2,213,625 | 9/1940 | Cummings | 200/156 |
| 4,002,088 | 1/1977 | Alsch | 200/153 P X |
| 4,013,847 | 3/1977 | Guidosh | 200/18 |
| 4,100,383 | 7/1978 | Piber | 200/157 |

*Primary Examiner*—Stephen Marcus
*Assistant Examiner*—Ernest G. Cusick
*Attorney, Agent, or Firm*—Charles F. Pigott, Jr.

[57] ABSTRACT

A multi-functional electromechanical vehicular switch having a linear ignition switch and a headlamp dimmer combined in a single unit. The ignition switch is constructed as a conventional design. The headlight dimmer employs a self-adjusting mechanism to insure the actuator gear remains in contact with a rack through a biased action if the rack over travels the partial gear of the dimmer mechanism.

4 Claims, 9 Drawing Figures

IGNITION SWITCH WITH SELF-ADJUSTING HEADLAMP DIMMER

BACKGROUND OF THE INVENTION

This invention relates in general to control switches for vehicles and, in particular, to a multifunctional electromechanical vehicular switch.

More specifically, but without restriction to the particular use which is shown and described, the invention relates to a mechanical vehicle switch combining the functions of a linear ignition switch and a headlight dimmer as a single unit. The headlight dimmer is provided with a unique, self-adjusting mechanism to improve operation.

As is well known, automobiles and other vehicles use separate switches to perform the diverse functions as an ignition switch and a headlamp dimmer. Each switch is mounted in separate positions for access by the driver and must be manipulated or adjusted in an independent manner. The use of two switches obviously involves a separate manufacture of the components and individualized installment of the switches during assembly of the vehicle. Such duplication of parts increases the manufacturing cost of the switch mechanism, increases assembly costs of the vehicle, and is less convenient to operate as separate units.

SUMMARY OF THE INVENTION

It is therefore an object of this invention to provide a multi-functional electromechanical vehicular switch combining the functions of an ignition switch and a headlamp dimmer.

Another object of the invention is to provide an improved headlight dimmer mechanism.

A further object of the invention is to provide a unique, self-adjusting mechanism for a headlight dimmer to insure long service and proper operation.

Still another object of the invention is to operate a headlight dimmer switch through a unique ratchet arrangement for improved operation.

A still further object of the invention is to convert linear motion of an actuator for a headlight dimmer to rotary motion for controlling the headlamp with improved results.

These and other objects are attained in accordance with the present invention wherein there is provided an improved multi-functional electromechanical vehicular switch combining an ignition switch and a headlight dimmer having a unique, self-adjusting mechanism. The combining of the two switch devices as a single unit eliminates the duplicate switch mechanisms required in prior art techniques to control these functions in a vehicle. The rotary dimmer mechanism of the invention is mounted atop a linear ignition switch of conventional characteristics. The rotary dimmer mechanism is actuated by a radial arm that extends from dimmer switch actuator means having an end termination in the form of gear rack means. Movement of the radial arm causes gear segment means, biased by spring means, to rotate through a predetermined angle in either direction before running out of engagement with the rack. The spring bias of the partial gear assures that the gear will remain in contact with the rack and "ratchet" if the rack over travels the partial gear segment. Rotation of the gear segment then mechanically drives the dimmer mechanism which has a bi-stable rotary escapement type mechanism.

BRIEF DESCRIPTION OF THE DRAWINGS

Further objects of the invention and advantages accruing therefrom will be apparent from the following description of a preferred embodiment of the invention which is shown in the accompanying drawings with like reference numerals indicating corresponding parts through-out, wherein.

DESCRIPTION OF A PREFERRED EMBODIMENT

Figure 1:
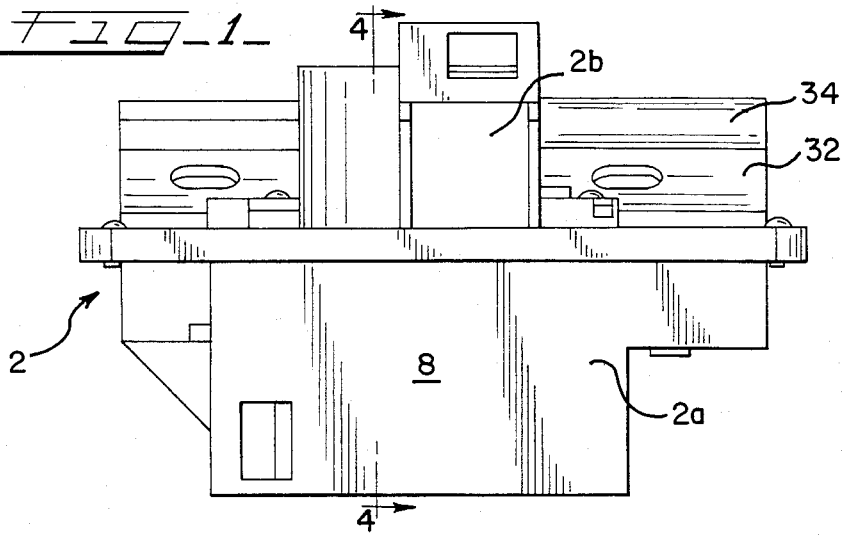
FIG. 1 is a side elevation view of the electromechanical switch of the invention.
Figure 2:
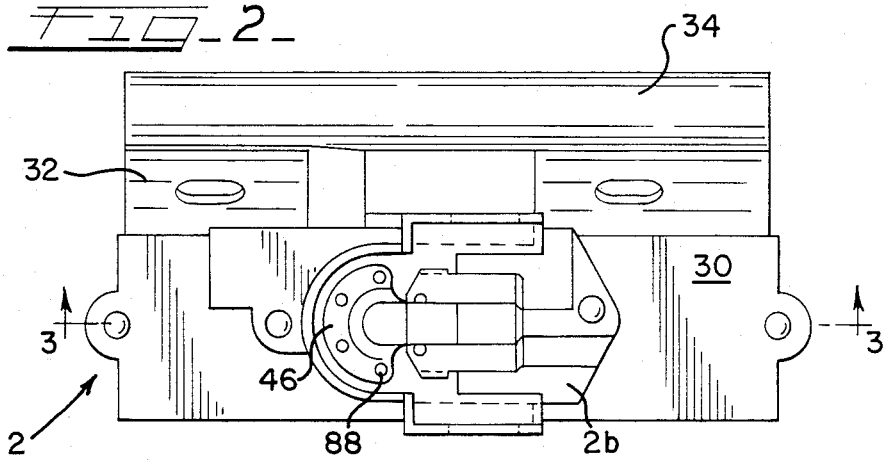
FIG. 2 is a top plan view of the electromechanical switch of FIG. 1.
Figure 3:
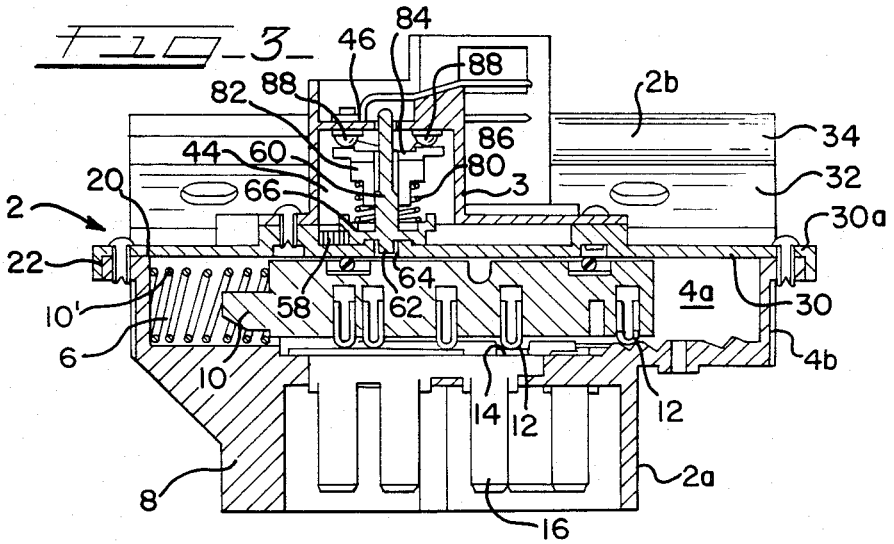
FIG. 3 is a vertical sectional view taken substantially along the line 3—3 of FIG. 2.

Referring now to FIGS. 1–9, there is illustrated the multi-functional electromechanical vehicle switch of the invention, generally designated by reference numeral 2. Essentially, the switch assembly 2 comprises a lower linear ignition switch device **2*a* upon which a headlamp dimmer device 2*b* is mounted in a "piggyback" relationship. The ignition switch portion 2*a* is of a general design for a linear ignition switch that is well known in the industry. The ignition switch 2*a* includes an upper housing portion 4 having an open top 4*a* and upright side walls 4*b* to form an actuator compartment 6. The bottom wall of the housing portion 4 merges with a lower switch housing portion 8 forming an open bottom and the bottom surface of the switch actuator compartment 6. A switch actuator 10 of known design is mounted for movement within the compartment 6, as best illustrated in FIG. 3, while being resiliently biased by spring 10'. A series of contacts 12 disposed on the bottom of the actuator 10 cooperate with conductive strips 14 in a known manner for functioning as an ignition switch. The contacts 14 are integrally coupled to terminals 16 which extend downward in the open bottom of the ignition switch housing portion 8** for connection with the ignition circuit (now shown) of vehicle.

Figure 4:
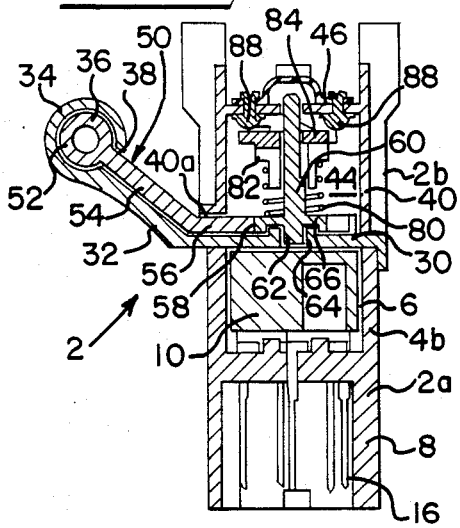
FIG. 4 is a vertical sectional view taken substantially along the line 4—4 of FIG. 1.
Figure 5:
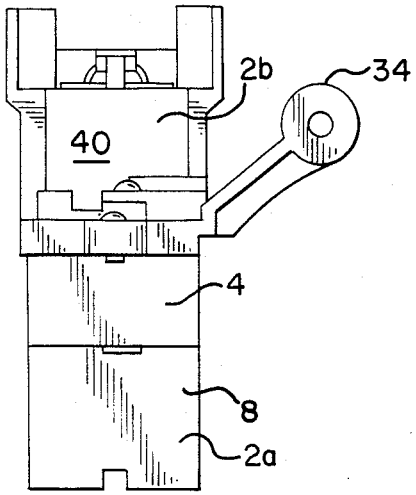
FIG. 5 is an end view of the electromechanical switch of FIG. 1.
Figure 6:
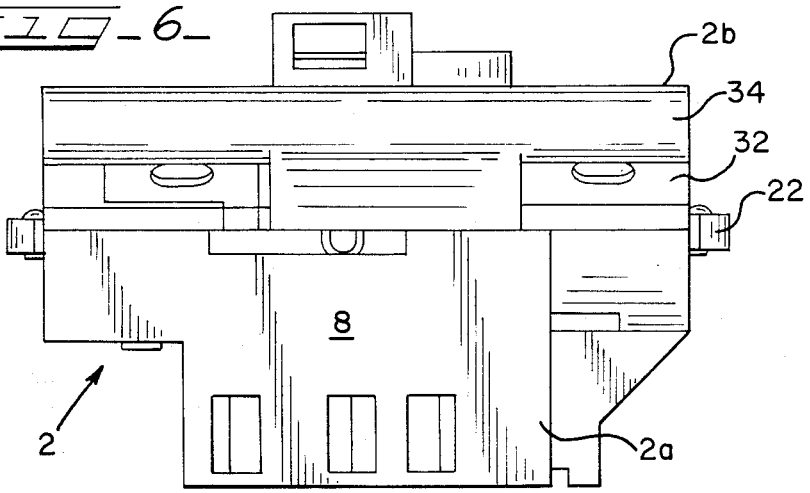
FIG. 6 is an opposite side view from the side shown in FIG. 1.
Figure 7:
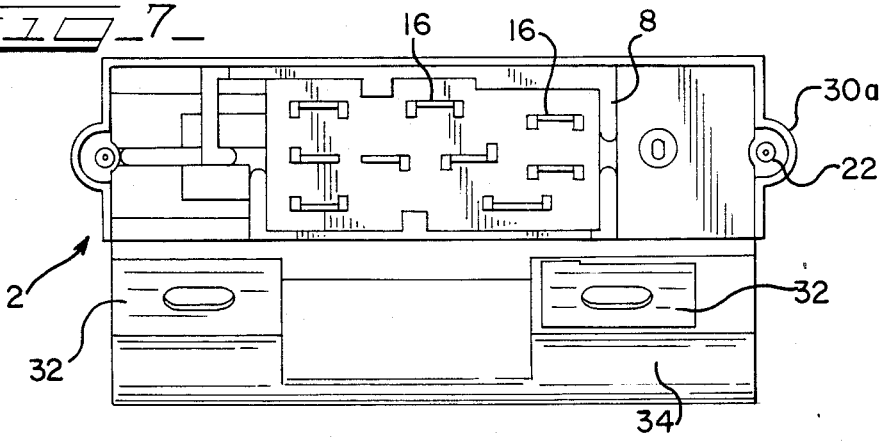
FIG. 7 is a bottom view of the electromechanical switch of FIG. 1.

The headlight dimmer switch **2*b* is mounted on a ledge 20 formed by the sides 4*b* of ignition switch housing portion 4 defining the compartment 6. An ear portion 22 having holes permits the dimmer switch 2*b* to be attached to the top of housing 4 in contacting relationship. The dimmer switch 2*b* is of a rotary design and includes a plate 30 having end projections 30*a* to permit attachment of the plate 30 to the ear portion 22 of the linear ignition switch through connecting screws and the like as shown in FIGS. 3, 4, 7, and 8. The plate 30 includes integral support plates 32 which project outward beyond the side wall of housing 4 in a slightly upward direction and carry an integral tubular actuator housing 34 having an open end 36 and an open elongated slot 38, as seen in FIG. 4. The other end (FIG. 5) of the tubular housing 34 is at least partially closed, such that a spring 42 is inserted into the actuator tube 34 to bear against the end as in FIG. 8**.

An actuator 50, having a tubular portion 52, is inserted into the tubular actuator housing 34. An arm 54 integrally attached to the tubular portion 52 is designed to extend through slot 38 and project from the actuator housing 34. The end of the projecting arm 54 is formed with a gear rack 56 having gear teeth 58. As seen in Fig. 4, the actuator 52 and arm 54 are disposed on support plates 32 and project into a housing 40 of the dimmer switch mechanism *2b* through an appropriate slot 40*a*. The housing 40 has a partially curved upper side wall and forms an internal compartment 44 which is defined by the side wall of the housing 40 and an upper wall 46, as best shown in FIGS. 3 and 4. The tubular portion 52 may undergo manual linear movement against spring 42 through appropriate means (not shown) operated by the driver.

Figure 8:
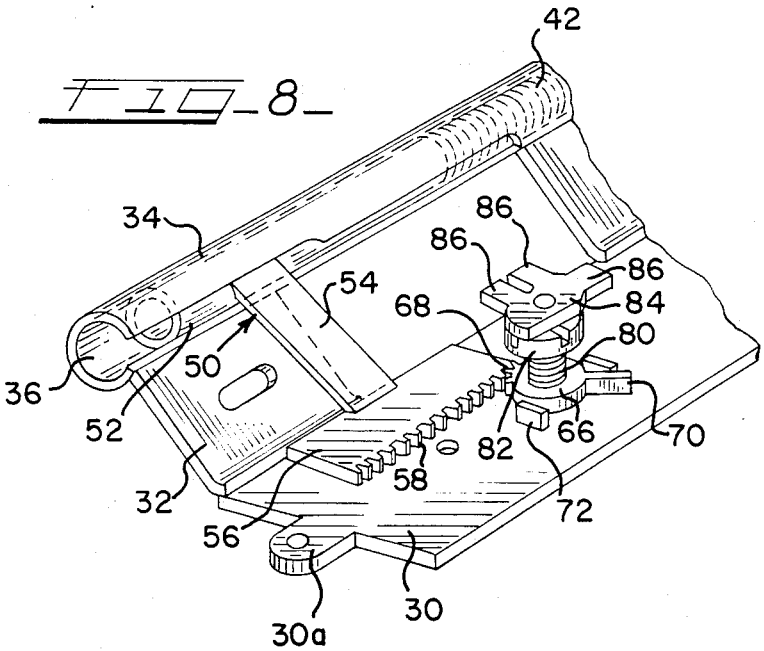
FIG. 8 is a partial perspective view of the actuator and resiliently biased gear segment of the electromechanical switch of FIG. 3.
Figure 9:
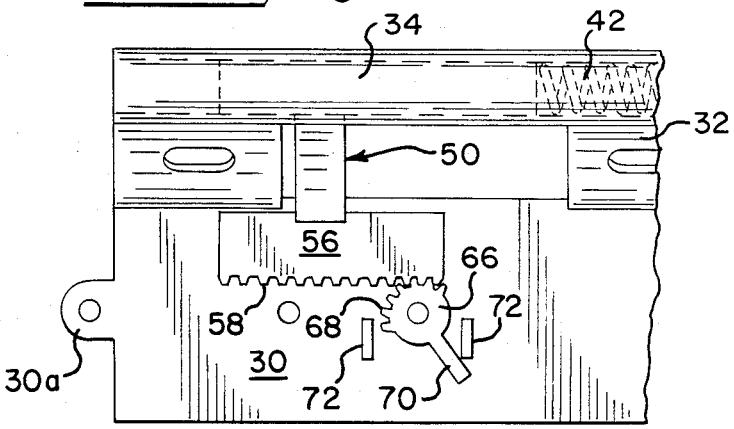
FIG. 9 is a fragmentary top plan view illustrating in particular the rack and pinion means of FIG. 8.

The dimmer switch assembly *2b* includes an upright central shaft 60 (see FIG. 3) having a bottom end 62 rotatably mounted in hole 64 of plate 30. The shaft 60 is constructed with an integral gear segment 66 having gear teeth 68 (FIG. 9) generally arranged in meshing relationship to gear teeth 58 of rack 56. An arm 70 projects outward from gear segment 66 and is intended to engage stops 72 formed on the plate 30 (FIGS. 8 and 9) for limiting the rotational movement of the pinion. The teeth 68 of gear segment 66 engage the rack teeth 58 to translate linear motion of the actuator 52 produced by the operator of the vehicle into a rotary movement of the gear segment 66. A spring 80 is mounted around a flat surface portion of the shaft 60 immediately above gear segment 66. The spring 80 has an upper portion that contacts a drive member 82 for resiliently biasing the pinion 66. The drive member 82 supports an upper contact member 84 having three contacting areas 86 (FIGS. 3 and 8). A plurality of contacts 88 (see FIG. 3) project through holes in wall 46 and are connected to the electrical circuit of the headlamps to accomplish a dimming function.

From the foregoing, it should be apparent that the dimming mechanism is controlled by movement of the actuator 50. The linear motion of the actuator is converted to rotary movement through engagement of the rack teeth 58 with the gear segment teeth 68. Rotation of the gear 66 is resiliently coupled to contact member 84 through resilient coupling spring 80. Movement of the actuator 50 will cause the upper contact areas 86 to undergo a degree of rotation of around 30° to accomplish a switching action by movement from one contact 88 to another. The switching mechanism of the dimmer comprises a bi-stable rotary escapement type mechanism well known in the art.

The gear segment 66 is spring biased by spring 80, such that the gear 66 rotates in a predetermined angle in either direction before running out of engagement with a rack. The spring bias of the gear segment 66 assures that the gear segment 66 will remain in contact with the rack, teeth 58, and perform ratchet-like functions, if the rack over travels gear segment 66. The spring bias further assures that gear segment 66 will engage the next tooth of the rack 58 upon its reversal after being rotated in one direction.

When attaching the ignition switch assembly *2a* to the steering column of a vehicle, the dimmer actuator 52 is engaged in the actuator housing 34 and the ignition switch *2a* is then attached to the column (not shown) in a conventional manner. The gear segment 66 will ratchet up to the point where the ignition swtich *2a* is properly adjusted and rigidly affixed. The dimmer actuator 52 is then operated and the gear rack 56 continues to "ratchet" throughout the full travel of the arm. As the arm 54 returns to its unactuated position, the gear segment 66 engages the rack 58, and henceforth, remains engaged. Subsequent operation to the dimmer actuator 50 causes the gear segment 66 to rotate through its predetermined rotary motion.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A combined automotive ignition switch and self-adjusting automotive dimmer switch, said dimmer switch being of the type having a rotatable contact member with a plurality of contact portions which engage corresponding contacts to effect a switching function, the improvement comprising, in combination, an automotive ignition switch assembly, a self-adjusting dimmer switch mechanism mounted directly on said ignition switch assembly so both are installed in a single operation, said self-adjusting dimmer switch mechanism including a rotatably mounted shaft connected at one end to said rotatable contact member for rotating the latter, gear segment means connected to the opposite end of said shaft for conjoint rotation therewith, dimmer switch actuator means, an arm extending radially from said dimmer switch actuator means, rack means connected to said arm for linear movement conjointly with said dimmer switch actuator means, said rack means being engaged with said gear segment means to rotate the latter upon linear movement of said rack means in either of two opposite directions, said gear segment means being rotatable by said rack means until said gear segment means reaches a predetermined position where said rack means is engaged with a last tooth at an end of said gear segment means, and spring means operative when said gear segment means is in said predetermined position for biasing said gear segment means in a direction opposite to the direction it is urged by said rack means as the latter completes its linear travel whereby upon actuation of said dimmer switch actuator means said rack means is moved linearly thereby rotating said gear segment means to said predetermined position where it remains biased by said spring means until said rack means ratchets past to complete its linear travel and then reverses direction at which time said gear segment means is rotated in the opposite direction and is in a predetermined relationship with said rack means.

2. A self-adjusting automotive dimmer switch mechanism of the type having a rotatable contact member with a plurality of contact portions which engage corresponding contacts to effect a swtiching function, the improvement comprising, in combination, a rotatably mounted shaft connected at one end to said rotatable contact member for rotating the latter, gear segment means connected to the opposite end of said shaft for conjoint rotation therewith, linearly movable rack means engaged with said gear segment means to rotate the latter upon linear movement of said rack means in either of two opposite directions, said gear segment means being rotatable by said rack means until said gear segment means reaches a predetermined position where said rack means is engaged with a last tooth at an end of said gear segment means, dimmer switch actuator means connected to said rack means for actuating the latter and thereby rotating said gear segment means, and spring means operative when said gear segment means is in said predetermined position for biasing said gear segment means in a direction opposite to the direction it is urged by said rack means as the latter completes its linear travel whereby upon actuation of said dimmer switch actuator means said rack means is moved linearly thereby rotating said gear segment means to said predetermined position where it remains biased by said spring means until said rack means ratchets past to complete its linear travel and then reverses direction at which time said gear segment means is rotated in the opposite direction and is in a predetermined relationship with said rack means.

3. A self-adjusting automotive dimmer switch mechanism as defined in claim 2 where said mechanism is mounted directly on an automotive ignition switch assembly whereby upon installation of said ignition switch assembly said dimmer switch mechanism will also be installed and will self-adjust upon the first actuation of said dimmer switch mechanism.

4. A self-adjusting automotive dimmer switch mechanism as defined in claim 2 where said dimmer switch actuator means has an arm extending radially therefrom, said rack means being connected to the end of said arm for linear movement conjointly with said dimmer switch actuator means.

* * * * *